United States Patent [19]

Scheurecker et al.

[11] 4,074,746

[45] Feb. 21, 1978

[54] SUPPORTING AND GUIDING STAND FOR CONTINUOUSLY CAST STRANDS

[75] Inventors: Werner Scheurecker, Linz; Franz Kagerhuber, Traun, both of Austria

[73] Assignee: Vereinigte Osterreichische Eisen- und Stahlwerke - Alpine Montan Aktiengesellschaft, Linz, Austria

[21] Appl. No.: 738,362

[22] Filed: Nov. 3, 1976

[30] Foreign Application Priority Data

Nov. 12, 1975 Austria ..... 8601/75

[51] Int. Cl.[2] ..... B22D 11/12

[52] U.S. Cl. ..... 164/442; 193/35 R; 226/189

[58] Field of Search ..... 164/273 R, 282; 193/35 R; 72/227, 240, 243, 248; 198/202, 167; 226/189

[56] References Cited

U.S. PATENT DOCUMENTS

| | | | |
|---|---|---|---|
| 3,550,674 | 12/1970 | Gallucci | 164/282 |
| 3,596,706 | 8/1971 | Knorr et al. | 164/282 |
| 3,981,348 | 9/1976 | Schmucker | 164/282 X |

*Primary Examiner*—Robert L. Spicer, Jr.
*Attorney, Agent, or Firm*—Brumbaugh, Graves, Donohue & Raymond

[57] ABSTRACT

A supporting and guiding stand for continuously cast strands, in particular slabs, has rollers forming oppositely arranged roller paths to support the strand, uninterrupted longitudinal carriers accommodating the rollers, transverse carriers spaced along the longitudinal carriers, driven rollers journaled on the transverse carriers via brackets, and adjustment means provided for adjusting the driven rollers to the strand or to a starter bar.

9 Claims, 6 Drawing Figures

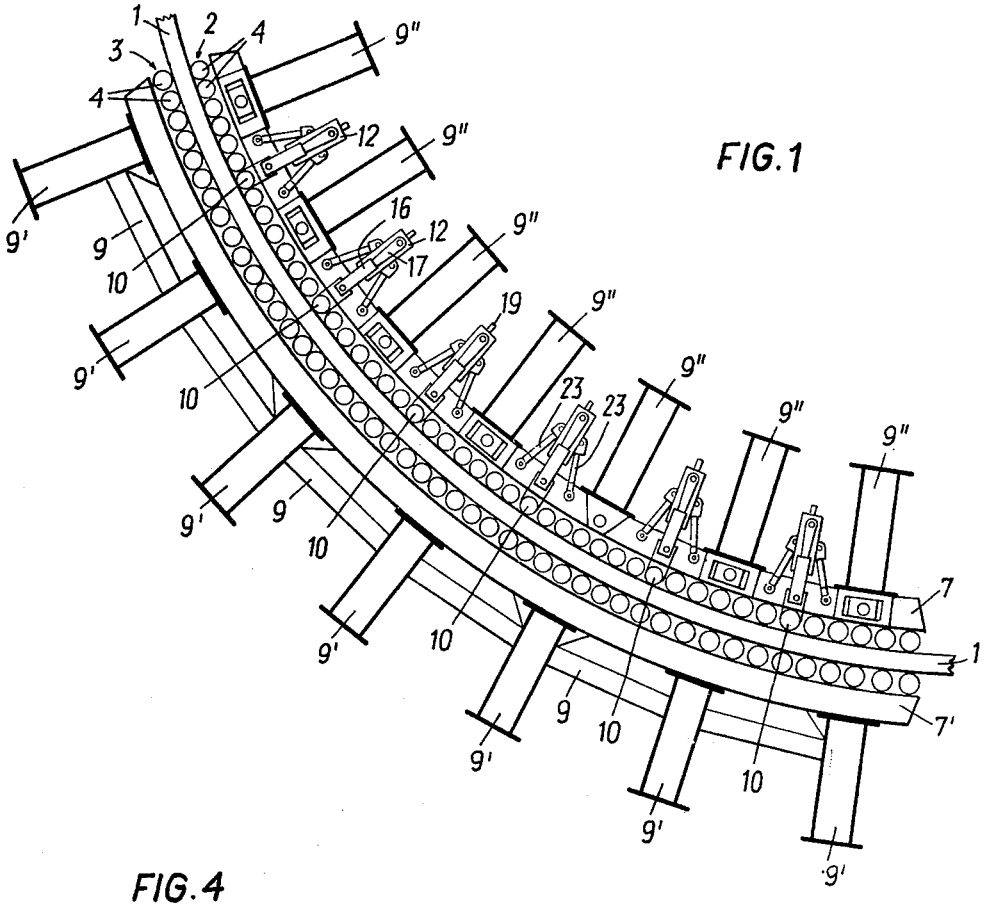
FIG. 1
FIG. 4
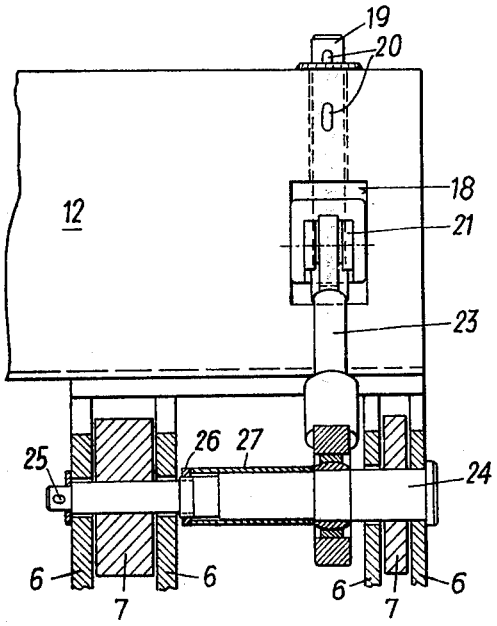

SUPPORTING AND GUIDING STAND FOR CONTINUOUSLY CAST STRANDS

BACKGROUND OF THE INVENTION

The invention relates to a supporting and guiding stand, in particular a supporting and guiding arc for continuously cast slabs, having roller paths supporting the strand at opposite sides thereof. The rollers which advantageously are divided, are journaled in uninterrupted longitudinal carriers formed in one piece. Suitably the longitudinal carriers of a roller path are adjustable or braceable, relative to the opposite roller path under elastic deformation to permit adjustment to various strand thicknesses.

By such a supporting and guiding arc, e.g. as described in Austrian Pat. No. 290,750 (U.S. Pat. No. 3,710,847), the strand is deflected from an approximately vertical direction into an approximately horizontal direction. The rollers lie precisely on pre-determined curved paths without discontinuities even after a re-adjustment of the roller path distance, so that no impermissible forces act on the strand skin. For this construction longitudinal carriers designed in one piece are essential, which longitudinal carriers extend over the entire length of the supporting and guiding arc.

In this supporting and guiding arc, the rollers are stationarily secured to the arcuate longitudinal carriers and are not drivable. When using a starter bar having a conical starter bar head and a thin starter bar body, the extraction of the cast strand is jerky. Only when the non-driven rollers have been passed, can extraction forces be applied to the strand or starter bar and therefore the starter bar has to have a corresponding length. It has been known to provide supporting and guiding arcs that are divided transversely to the longitudinal direction and whose roller path segments are mounted in separate stands supported on the base. The drivable pressure rollers, which are adjustable to the smallest cross-section of differing starter bar heads, are mounted in individual stands separate from the stands for the supporting rollers (German Auslegeschrift 1,758,533). As soon as the starter bar head of the starter bar approaches a pressure roller, the pressure forces acting on the pressure roller will be neutralized at this pressure roller, and the respective pressure roller is adjusted to the dimension of the cast strand. The running faces facing the strand of all the rollers must be precisely aligned, in order not to cause an unnecessary deformation of the strand and thus an increased extraction force or even cracks in the strand skin. A disadvantage of the construction described in German Auslegeschrift 1,758,533 consists in that the precise adjustment of the pressure rollers mounted independently of the supporting rollers in separate stands, to the thickness of the cast strand is difficult to carry out. It is a further disadvantage that whenever the strand thickness changes, the position of the pressure rollers has to be re-adjusted in addition to the position of the supporting rollers.

SUMMARY OF THE INVENTION

The invention aims at preventing these disadvantages and difficulties and has as its object to create a supporting and guiding stand of the above-defined kind having driven rollers adjustable to the starter bar which driven rollers are distributed over the longitudinal extension of the stand and are located between the support rollers of the roller paths, while maintaining the construction of the guiding stand in one piece. In particular, the longitudinal carriers are constructed in one piece extending over its entire length. It is a special object of the invention to mount the rollers so as to be adjustable to the strand or the starter bar in such a manner that when the supporting roller distance is changed to accommodate a different strand thickness, the setting of the adjustable driven rollers which are in precise alignment with the supporting rollers, is maintained. Thus a separate adjustment of the adjustable rollers to the strand thickness is rendered unnecessary and enables a resetting of the supporting and guiding path to a strand of different size within as short a period of time as possible.

According to the invention these objects are achieved in that transvere carriers are arranged along the uninterrupted longitudinal carrier(s) at a distance from one another. Driven rollers are mounted on said transverse carriers by means of supporting brackets and are adjustable relative to the strand or to a starter bar in the direction towards the oppositely arranged roller path by adjustment means engaging the supporting brackets or the transverse carriers.

Advantageously, the transvere carriers are arranged outside the space defined by the roller paths and are parallel to the roller axes so as to back up the longitudinal carriers. The adjustable driven rollers are secured to the transverse carriers by means of supporting brackets laterally arranged on both sides of each longitudinal carrier.

According to a preferred embodiment, the transverse carriers are guided perpendicularly to the roller path by means of guiding pins secured to the transverse carriers, which guiding pins each penetrate a guiding piece secured to the longitudinal carriers, and also by means of guiding bolts arranged parallel to the roller axes and rigidly secured to the longitudinal carriers, which guiding bolts penetrate the supporting brackets.

Suitably, the guiding pieces are articulately connected with the longitudinal carriers by swing arms hinged to their ends in the manner of a trapezoid four bar linkage.

As adjustment means, advantageously pressure medium cylinders are provided for each transverse carrier, which cylinders are hinged, on the one hand, to the end faces of the transverse carriers and, on the other hand, to the guiding bolts.

In another preferred embodiment, according to which the transverse carriers can be especially space-savingly accommodated in the supporting and guiding arc, the transverse carriers are rotatably secured to a roller path, connected with the rollers by brackets, and rotated by means of pressure medium cylinders engaging the brackets.

BRIEF DESCRIPTION OF THE DRAWINGS

The invention shall now be described by way of two embodiments both showing an arcuate strand guiding path, although a straight-line guiding path can be used, and with reference to the accompanying drawings in which:

FIG. 1 is a schematically illustrated side view of a guiding arc, wherein the framework supporting the guiding arc is partly missing;

FIGS. 3 and 4 show sections along lines III—III and IV—IV, respectively; of FIG. 2, FIGS. 5 and 6 show a different embodiment of the invention, FIG. 5 being a section like FIG. 2, and FIG. 6 being a section along line VI—VI of FIG. 5.

DESCRIPTION OF EXEMPLARY EMBODIMENTS

Figure 2:
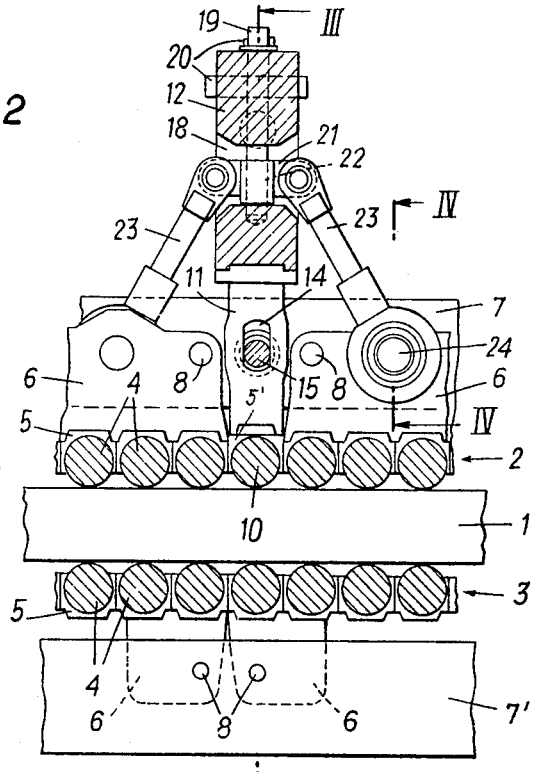
FIG. 2 is a detail of a vertical section in the longitudinal direction of a portion of the guiding arc and on an enlarged scale.

A the cast strand 1 is guided and supported between roller paths 2 and 3. The rollers 4 are journaled in a plurality of bearings 5 distributed over their longitudinal extension, which bearings 5 are mounted in arcuate longitudinal carriers 7 and 7' via bearing supports 6. As can be seen in FIG. 2, a number of adjacent rollers 4 are always secured in a common bearing support, the bearing support being fixed on the longitudinal carriers 7 and 7' by the bolts 8. The arcuate longitudinal carriers 7' are built into a rigid arcuate framework comprised of props 9 and carriers 9' arranged transversely to the longitudinal carriers 7'. The arc-inner longitudinal carriers 7 are supported by the carriers 9'' each, the carriers 9'' being arranged opposite the carriers 9' and being fixable on the framework by means of drawing anchors not illustrated in detail. Advantageously, the arcuate longitudinal carriers 7 are adjustable or braceable relative to the framework under elastic deformation for adjustment to various strand thicknesses.

Figure 3:
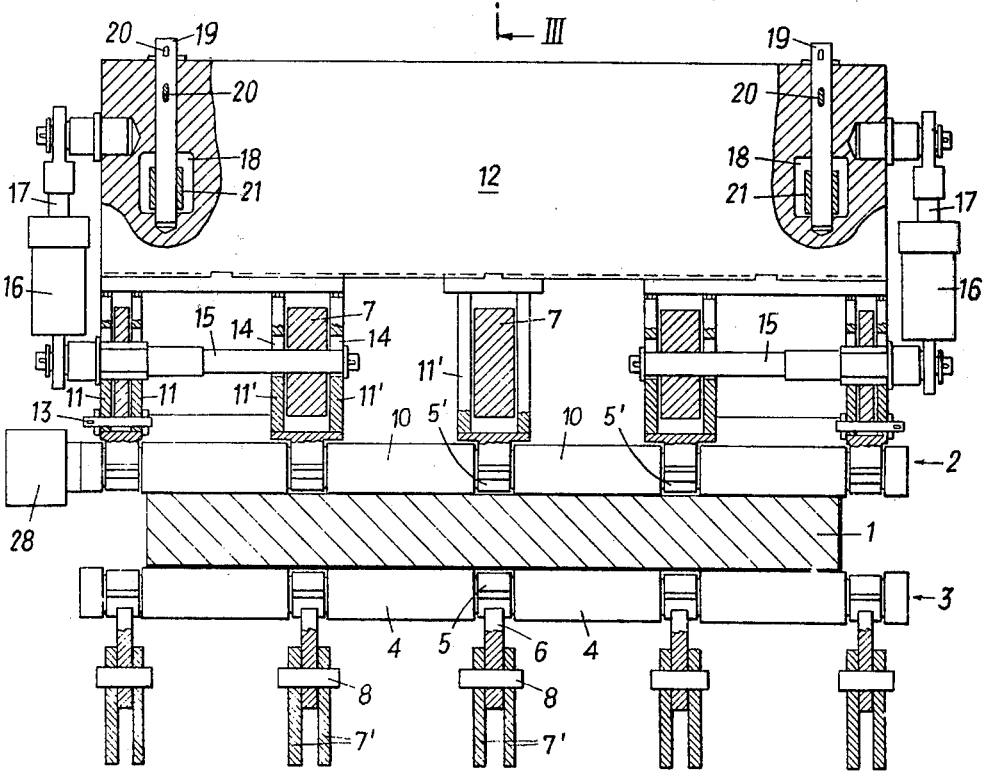

Between the bearing supports 6 arranged on the longitudinal carriers 7 one behind the other, distances are provided which serve for accommodating drivable rollers 10 capable of being moved relative to the rollers 4 in a direction toward the opposite roller path 3. Each roller 10 is multiply divided over its longitudinal extension (FIG. 3) and is journaled on each point of partition. Each bearing 5' is supported by two supporting brackets 11 or 11', respectively, laterally arranged on both sides of each arcuate longitudinal carrier 7 so as to point perpendicularly to the roller path 2. The pairs of brackets are screwed to a transverse carrier 12. The transverse carriers 12 are arranged at a distance outside of the space defined by the roller paths 2 and 3 and parallel to the roller axes. By wedges 13 the rollers 10 are secured to the outwardly arranged supporting brackets 11 provided on the edges of the roller path 2. The inwardly arranged supporting brackets 11' provided between the edges of the roller path 2 only serve to support the rollers, i.e. they are only loaded when the roller 10 is pressed against them from the oppositely arranged roller path side. The brackets 11 and 11' arranged on both sides of the two outwardly arranged arcuate longitudinal carriers 7 are provided with long holes 14 penetrated by guiding bolts 15, each bolt extending through the two outwardly arranged arcuate longitudinal carriers 7 and being rigidly secured thereto. To the outwardly arranged end of each guiding bolt 15, a pressure medium cylinder 16 is hinged, which cylinder is articulately connected via its piston rod 17 with the end of the transverse carrier 12 arranged thereabove.

Each transverse carrier 12, near its ends, is provided with a recess 18 extending therethrough. The recess is penetrated by a guiding pin 19 directed perpendicular to the roller path and rigidly secured to the transverse carrier by means of inserts 20. A guiding piece 21, into whose bore 22 the guiding pin is inserted (FIG. 2), is hinged to the longitudinal carriers 7 by means of swing arms 23 in the manner of a trapezoid four bar linkage (FIG. 4) so as to form a guiding device for the transverse carrier. The hinging of the swing arms 23 to the longitudinal carriers is effected by means of a stepped bolt 24 which penetrates the two outer longitudinal carriers and the bearing supports 6 mounted thereon and which is rigidly connected thereto by means of a wedge connection 25 (FIG. 4). The swing arms 23 are secured in their position on the stepped bolts 24 by means of an adjusting nut 26 which is braceable relative to a sleeve 27 resting on the respective swing arm.

By actuating the pressure medium cylinders 16 the transverse carrier 12 can be moved in a direction perpendicular to the roller path 2, while it slides with its guiding pin 19 in the bore 22 of the guiding piece 21 and with the long holes 14 of the brackets 11 secured to it along the guiding bolts 15. The length of the long holes 14 limits the area of movement and thus the adjustment path of the rollers 10. This length is such that, on the one hand, the thin starter bar body can safely be pressed towards the opposite roller path 3 by the rollers 10 and that, on the other hand, when adjusting the rollers 10 in the opposite direction the rollers 10 together with the neighbouring rollers 4 give the desired arcuate strand guide path. The rollers 10 are provided with a slip-on motor 28 at one of their ends.

Figure 5:
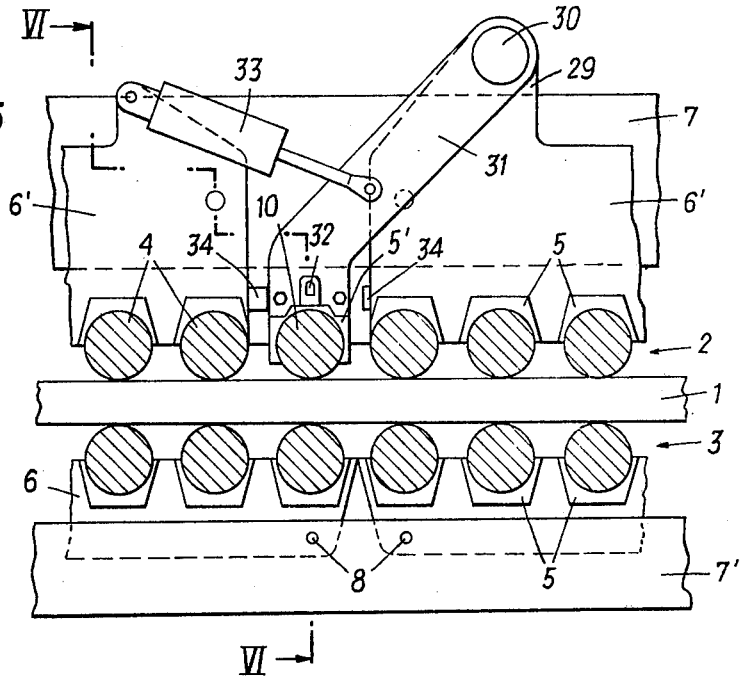
Figure 6:
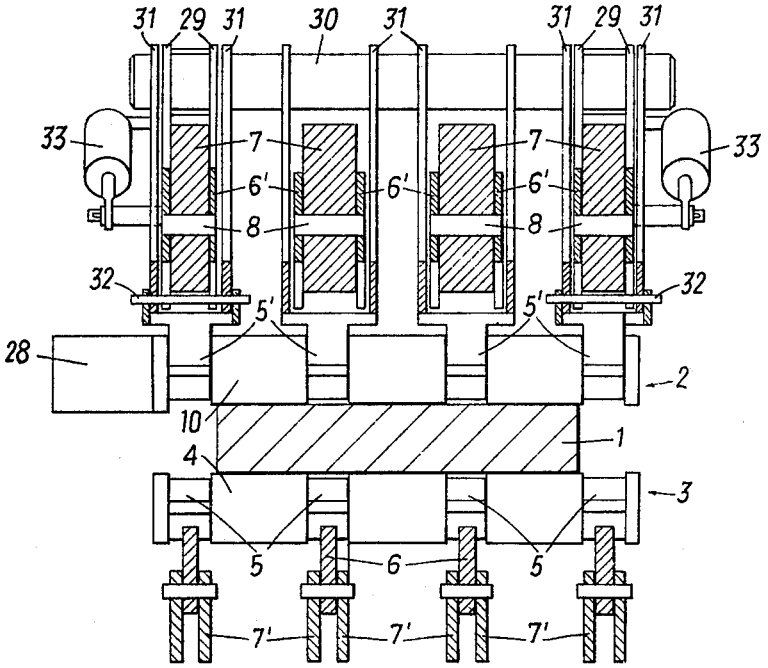

According to another embodiment of the invention shown in FIGS. 5 and 6 transverse carriers 30 are arranged parallel to the roller axes and outside of the roller paths. The transverse carriers 30 are rotatably journaled in noses 29 of the bearing supports 6' that are arranged on the edges of the roller path 2. On each transverse carrier 30 brackets 31 are secured at an inclined acute angle to the longitudinal direction of the roller path, which brackets 31 extend on both sides of each longitudinal carrier up to the bearings 5' of the roller 10. The rollers 10 are secured on the outwardly arranged brackets 31 by a wedge connection 32. By means of two pressure medium cylinders 33 arranged at both sides of the roller path 2, which pressure medium cylinders 33 are hinged, on the one hand, to the brackets 31 and, on the other hand, to the opposite bearing supports 6' of the neighbouring rollers 4, the transverse carrier 30 can be rotated, whereby the roller 10 moves toward or away from the opposite roller path 3. On the bearing supports 6' of the neighbouring rollers, stops 34 are arranged so as to limit the area of movement of the rollers 10. The resistance of the transverse carriers 30 against torsion is such that unpermissible saggings of the rollers 10 do not occur, i.e., that the fatigue strength under reversed bending stresses of the rollers 10 is not exceeded.

During the casting operation, the pressure medium cylinders 16 and 33 are actuated in such a manner that the rollers 10 are pressed onto the strand only with such a pressure as is certainly smaller than the ferrostatic pressure corresponding to the dimension of the slab. In this manner it is assured that during casting the rollers 10 are exactly aligned with the supporting rollers 4. If the cast strand to be conveyed shrinks, or if the starter bar is to be conveyed, the rollers 10 follow the surface of the strand with the pressure force, set. Thus an extraction force having the magnitude of the pressure force multiplied by the respective friction value of the starter bar or the cast strand remains safeguarded.

We claim:

1. In an arc-shaped supporting and guiding stand for continuously cast strands of the type including supporting rollers forming oppositely arranged roller paths to support the strand and uninterrupted longitudinal carriers formed in one piece for accommodating said supporting rollers, the improvement comprising:

transverse carriers arranged along the uninterrupted longitudinal carriers parallel to the axes of the supporting rollers at a distance from one another and outside a space defined by the oppositely arranged roller paths;

supporting brackets connected to said transverse carriers and being arranged laterally of the longitudinal carriers;

driven rollers journaled on said transverse carriers via said supporting brackets; and adjustment means provided for moving said supporting bracket so as to adjust said driven rollers to the strand or to a starter bar passed between the oppositely arranged roller paths in a direction toward or way from the respective oppositely arranged roller path.

2. A supporting and guiding stand as set forth in claim 1, wherein said driven rollers are multiply divided over their longitudinal extension.

3. A supporting and guiding stand as set forth in claim 1, wherein the longitudinal carriers of one of said oppositely arranged roller paths are elastically deformable and braceable relative to the other one of said oppositely arranged roller paths for adjustment to various thicknesses of the strand.

4. A supporting and guiding stand as set forth in claim 1, wherein said adjustment means provided for said driven rollers engage said supporting brackets and the longitudinal carriers.

5. A supporting and guiding stand as set forth in claim 1, wherein said adjustment means provided for said driven rollers engage said transverse carriers and the longitudinal carriers.

6. In an arc-shaped supporting and guiding stand for continuously cast strands of the type including supporting rollers forming oppositely arranged roller paths to support the strand and uninterrupted longitudinal carriers formed in one piece for accommodating said supporting rollers, the improvements comprising:

transverse carriers arranged along the uninterrupted longitudinal carriers parallel to the axes of the supporting rollers at a distance from one another and outside a space defined by the oppositely arranged roller paths;

supporting brackets connected at one end to said transverse carriers and being arranged laterally of the longitudinal carriers;

driven rollers journaled on the other end of said supporting brackets;

adjustment means provided for changing the distance of said transverse carrier from the respective oppositely arranged roller paths so as to adjust said driven rollers to the strand or to a starter bar passed between the oppositely arranged roller paths;

guiding pins secured to said transverse carriers;

guiding devices connected to the longitudinal carriers and having bores penetrated by said guiding pins; and guiding bolts rigidly secured to the longitudinal carriers and extending parallel to the roller axes, said guiding bolts penetrating guiding slots in at least some of said supporting brackets, said transverse carriers being guided substantially perpendicularly to the pertaining roller path by means of said guiding pins being guided in said bores of said guiding devices and said guiding bolts being guided in said guiding slots of said supporting brackets.

7. A supporting and guiding stand as set forth in claim 6, wherein said guiding devices include guiding pieces penetrated by said guiding pins and swing arms hinged to the ends of the guiding pieces, said swing arms articulately connecting the guiding pieces with the longitudinal carriers in trapezoidal-four-bar-linkage fashion.

8. A supporting and guiding stand as set forth in claim 6, wherein said adjustment means are pressure medium cylinders, each being hinged, on the one hand, to an end face of the pertaining transverse carrier and, on the other hand, to the pertaining guiding bolt.

9. In an arc-shaped supporting and guide stand for continuously cast strands of the type including supporting rollers forming oppositely arranged roller paths to support the strand and uninterrupted longitudinal carriers formed in one piece for accommodating said supporting rollers, the improvement comprising:

transverse carriers arranged along the uninterrupted longitudinal carriers parallel to the axes of the supporting rollers at a distance from one another and outside a space defined by the oppositely arranged roller paths, said transverse carriers being rotatably secured to one of said oppositely arranged roller paths;

inclined supporting brackets connected at one end to said transverse carriers and being arranged laterally of the longitudinal carriers;

adjustable driven rollers connected to the other end of said brackets; and pressure medium cylinders connected between said brackets and the longitudinal carriers for rotation of said transverse carriers and for varying the distance of said adjustable driven rollers from the respective oppositely arranged roller paths.

* * * * *